US008406660B2

(12) United States Patent
Hokkyoh et al.

(10) Patent No.: US 8,406,660 B2
(45) Date of Patent: Mar. 26, 2013

(54) IMAGE FORMING APPARATUS INCLUDING COUNTER-ROTATING DEVELOPING ROLLERS AND CONTROLLING METHOD

(75) Inventors: Tomonari Hokkyoh, Ibaraki (JP); Hiroaki Maeda, Kanagawa (JP); Katsuhiro Akinaga, Ibaraki (JP); Koutarou Yamada, Ibaraki (JP)

(73) Assignee: Ricoh Company, Ltd., Tokyo (JP)

( * ) Notice: Subject to any disclaimer, the term of this patent is extended or adjusted under 35 U.S.C. 154(b) by 366 days.

(21) Appl. No.: 12/700,064

(22) Filed: Feb. 4, 2010

(65) Prior Publication Data

US 2010/0209127 A1 Aug. 19, 2010

(30) Foreign Application Priority Data

Feb. 19, 2009 (JP) ..... 2009-036867
Nov. 24, 2009 (JP) ..... 2009-266730

(51) Int. Cl.
*G03G 15/08* (2006.01)

(52) U.S. Cl. ..... 399/269

(58) Field of Classification Search ..... 399/53, 399/264, 265, 267, 269, 279, 296, 384
See application file for complete search history.

(56) References Cited

U.S. PATENT DOCUMENTS

| | | | | |
|---|---|---|---|---|
| 4,559,509 | A | 12/1985 | Mayer | |
| 5,023,664 | A * | 6/1991 | Koefferlein et al. | 399/264 |
| 5,036,364 | A * | 7/1991 | Murasawa | 399/236 |
| 6,567,625 | B1 * | 5/2003 | Tatematsu et al. | 399/75 |
| 6,636,717 | B2 * | 10/2003 | Itoh | 399/269 |
| 7,466,946 | B2 * | 12/2008 | Tsujita et al. | 399/269 |
| 7,610,002 | B2 * | 10/2009 | Kabashima | 399/269 |
| 7,783,209 | B2 * | 8/2010 | Uno et al. | 399/27 |
| 2002/0164182 | A1 * | 11/2002 | Nakamura et al. | 399/336 |

FOREIGN PATENT DOCUMENTS

| | | | |
|---|---|---|---|
| JP | 58-14788 | | 1/1983 |
| JP | 60-68365 | | 4/1985 |
| JP | 01076084 | A * | 3/1989 |
| JP | 04233563 | A * | 8/1992 |
| JP | 8-36300 | | 2/1996 |
| JP | 09258559 | A * | 10/1997 |
| JP | 11-258905 | | 9/1999 |
| JP | 3203677 | | 6/2001 |
| JP | 3624666 | | 12/2004 |
| JP | 2008-129415 | | 6/2008 |
| JP | 2008-216555 | | 9/2008 |
| JP | 2008-257225 | | 10/2008 |

* cited by examiner

*Primary Examiner* — Robert Beatty
(74) *Attorney, Agent, or Firm* — Oblon, Spivak, McClelland, Maier & Neustadt, L.L.P.

(57) ABSTRACT

The disclosed image forming apparatus includes a rotatable image holding body configured to hold an electrostatic latent image on a surface of the image holding body, a developing device including a forward rotation developing roller rotatable in a same rotational direction as that of the rotatable image holding body and a reverse rotation developing roller rotatable in a reverse rotational direction to that of the rotatable image holding body, which supply a two-component developer to the surface of the image holding body to form a toner image corresponding to the electrostatic latent image, and a control unit configured to control rotation of the image holding body, the forward rotation developing roller, and the reverse rotation developing roller to supply the two-component developer. The control unit controls the rotation of the image holding body to start after a predetermined time period from starting the rotation of the forward rotation developing roller and the reverse rotation developing roller.

9 Claims, 10 Drawing Sheets

IMAGE FORMING APPARATUS INCLUDING COUNTER-ROTATING DEVELOPING ROLLERS AND CONTROLLING METHOD

BACKGROUND OF THE INVENTION

1. Field of the Invention

The present invention relates to an image forming apparatus such as a copy machine, a printer, and a multifunctional peripheral. More particularly, the present invention relates to an image forming apparatus for forming a toner image by providing a latent image formed on an image holding body with reversal development using a two-component developer which is made of toner and carrier, and a control method thereof.

2. Description of the Related Art

An image forming apparatus according to a related art includes a photoreceptor as an image holding body, a charging device for charging the surface of the photoreceptor to have a predetermined voltage, an exposure device for forming an electrostatic latent image by exposing the surface of the photoreceptor with a light source such as a laser element and a LED, and a developing device for developing the electrostatic latent image. The electrostatic latent image formed on the surface of the photoreceptor is developed by the developing device to be a toner image. The developing device develops the photoreceptor using a two-component developer containing toner which has undergone frictional charging and carrier.

According to the related art, it is required to prevent toner and carrier that unnecessarily become airborne during development from adhering to the photoreceptor in order to prevent degradation of an image. Therefore, in the image forming apparatus according to embodiment of the present invention, setup of operations timing such as charging the photoreceptor, application of a developing bias and driving the developing roller are important. Therefore, there have been proposed various setting methods.

FIG. 1 illustrates an ordinary method of setting an action of the image forming apparatus according to the related art. In the example of FIG. 1, a developing bias voltage is started to be applied to a developing roller at a time when a charged region of a photoreceptor, which is charged by a charging device, reaches a position facing the developing roller. Further, the developing roller is started to be moved at a time when an electrostatic latent image (image unit) on a surface of the photoreceptor, which is exposed to light in correspondence with image information by an exposure device, reaches a position facing the developing roller.

Reference sign S1 in FIG. 1 designates a turnaround time until the charged region of the photoreceptor reaches the position facing the developing roller. Reference sign S2 designates a turnaround time until the electrostatic latent image formed on the surface of the photoreceptor reaches a position facing the developing roller.

According to the setting method of the related art, the developing roller is driven only when the electrostatic latent image on the photoreceptor reaches a position facing the developing roller. Therefore, it is possible to minimize events such that toner and carrier on the developing roller become unnecessarily airborne and moves toward or adheres to the photoreceptor with an electrical potential difference between the developing roller and the photoreceptor.

FIG. 2 schematically illustrates the electric potential of the surface of the photoreceptor when the rotating photoreceptor passes the position facing the developing roller. FIG. 2 illustrates a case where the photoreceptor and the developing roller are operated at a timing illustrated in FIG. 1.

Referring to FIG. 2, the photoreceptor is uniformly charged to have an electric potential VH by the charging device, and a developing bias voltage VB is applied to the developing roller. At a timing t1 of FIG. 2, an uncharged region (0 V) of the photoreceptor, which is not charged by the charging device, passes through the position facing the developing roller. At timing t2 of FIG. 2, a charged region of the photoreceptor reaches the position facing the developing roller. At timing t3 of FIG. 2, the charged region of the photoreceptor passes through the position facing the developing roller. At timing t4 of FIG. 2, the developing roller is started to be driven. Reference sign K designates a carrier adhered onto the photoreceptor.

Further, after the developing roller is started to be driven, the electric potential of a portion of the latent image is depressed with exposure of light for forming an image by the exposure device. The electric potential of the depressed portion of the latent image becomes a voltage VL of the latent image. The depressed portion reaches the position facing the developing roller. Toner T contained in the two-component developer is electrostatically attracted onto the latent image by an action of the developing bias voltage.

When the various actions are done at the above-mentioned timings t1 thru t4 and so on, the developing roller may be stopped while the photoreceptor charged by the charging device rotates. The developing roller stops between the timing t2 and the timing t4.

FIGS. 3A and 3B illustrate operations of the photoreceptor in the image forming apparatus of the related art. As illustrated in FIG. 3A, when the photoreceptor 30 rotates along with developer D adhered onto the photoreceptor 30 in a development area 31 between the photoreceptor 30 and the developing roller 32, the developer D may be pulled toward a downstream side of a rotational direction of the photoreceptor 30.

Referring to FIG. 3B, when the developing roller 32 starts to be driven while the developer D is pulled toward the downstream side of the rotational direction, the developer D held by an action of the magnetic force of the developing roller 32 is pulled outside a range where the action of the magnetic force is effective. As a result, the action of magnetic force of the developing roller 32 does not reach the developer D. Then, the developer D is separated from the developing roller 32 and electrostatically attracted by the charged region of the photoreceptor 30. The attracted developer D is shaped like a belt along an axial direction of the photoreceptor 30, and adheres to the photoreceptor 30.

As examples of the related art, Patent Document 1 and Patent Document 2 disclose that carrier is prevented from adhering to a photoreceptor by driving a developing roller before a charged region of a photoreceptor reaches a position facing the developing roller. Further, Patent Document 3 discloses a developing device equipped with plural developing rollers.

Patent Documents 4 and 5 disclose that the angle of a developing magnetic pole unit of a developing device having two developing rollers, a gap between the developing rollers and a photoreceptor, and a doctor gap between a doctor blade and the developing rollers are determined.

However, there is a likelihood that the carrier adheres to a region other than the position facing the developing roller on the surface of the photoreceptor. Further, the carrier airborne inside the developing device may intrude into a cleaner to thereby damage or degrade the photoreceptor during the cleaning.

When the developer is degraded and the doctor blade wears, the developer may clog a development gap provided between the developing rollers and the photoreceptor, and a phenomenon may occur that the photoreceptor is stopped rotating. Hereinafter, such stopping of the photoreceptor is referred to as photoreceptor rotation locking. Further, the photoreceptor rotation locking is apt to occur when the image forming apparatus repeats starting and stopping operations at short cycles by continuously repeating intermittent printing.

There is a so-called fountain type developing device including a developing roller which is rotatable in a direction the same as that of a photoreceptor and is positioned on an upstream side, and another developing roller which is rotatable in a direction reverse to that of a photoreceptor and is positioned on a downstream side. The photoreceptor rotation locking is especially apt to occur at a position between the developing roller which is rotatable in the direction the same as that of the photoreceptor and the photoreceptor. Further, the photoreceptor rotation locking is especially apt to occur when a processing speed of forming an image is high. Therefore, it is necessary to consider appropriate values of a development gap, a magnetic pole angle or the like in addition to drive controls of the development gap and the magnetic pole angle.

However, these problems of adhesion of the carrier, image degradation, and photoreceptor rotation locking are not considered to be solved in Patent Documents 1 and 2. Further, it is not at all disclosed in Patent Documents 4 and 5 that timings of starting to rotate the photoreceptor and the developing roller are controlled. Patent Document 3 does not disclose that a timing of starting to rotate the photoreceptor and a timing of starting to rotate the developing roller are controlled, nor how the magnetic pole angle or the like is set.

The developing magnetic pole unit having a structure illustrated in FIG. 9 is partly described in Patent Document 6. However, controls of timing of starting rotation of a photoreceptor and timing of starting to rotate a developing roller are not disclosed in Patent Document 6.

Patent Document 1: Japanese Patent No. 3624666

Patent Document 2: Japanese Patent No. 3203677

Patent Document 3: Japanese Unexamined Patent Application Publication No. 2008-257225

Patent Document 4: Japanese Unexamined Patent Application Publication No. 2008-129415

Patent Document 5: Japanese Unexamined Patent Application Publication No. Hei. 11-258905

Patent Document 6: Japanese Unexamined Patent Application Publication No. Hei. 8-36300.

SUMMARY OF THE INVENTION

Accordingly, embodiments of the present invention provide a novel and useful image forming apparatus and a control method solving one or more of the problems discussed above.

More specifically, the embodiments of the present invention may provide the image forming apparatus and the control method which form a good image by preventing, when a two-component developer is used, developer from clogging a gap between a developing roller and a photoreceptor to thereby stop rotation of the photoreceptor.

One aspect of the embodiment of the present invention may be to provide an image forming apparatus comprising including a rotatable image holding body configured to hold an electrostatic latent image on a surface of the image holding body, a developing device including a forward rotation developing roller rotatable in a same rotational direction as that of the rotatable image holding body and a reverse rotation developing roller rotatable in a reverse rotational direction to that of the rotatable image holding body, which supply a two-component developer to the surface of the image holding body to form a toner image corresponding to the electrostatic latent image, a control unit configured to control rotation of the image holding body, the forward rotation developing roller, and the reverse rotation developing roller to supply the two-component developer, whereby the control unit controls the rotation of the image holding body to start after a predetermined time period from starting the rotation of the forward rotation developing roller and the reverse rotation developing roller.

Additional objects and advantages of the embodiments will be set forth in part in the description which follows, and in part will become obvious from the description, or may be learned by practice of the invention. Objects and advantages of the invention may be realized and attained by means of the elements and combinations particularly pointed out in the appended claims.

It is to be understood that both the foregoing general description and the following detailed description are exemplary and explanatory only and are not restrictive of the invention as claimed.

DETAILED DESCRIPTION OF THE PREFERRED EMBODIMENTS

A description is given below, with reference to the FIG. 4 through FIG. 10 of embodiments of the present invention.

In the embodiment, the reference signs typically designate as follows: 41, 42, 43: developing roller; 44: carrier catch roller; 45: carrying roller; 46: regulation plate; 100: image forming apparatus; 110: photoreceptor; 120: charging device; 130: exposure device; and 140: developing device.

The embodiment is provided to appropriately control timings of starting rotations of a developing roller and a photoreceptor in order to prevent a phenomenon (hereinafter, referred to as photoreceptor rotation locking) of stopping rotation of the photoreceptor by clogging a development gap between the developing roller and the photoreceptor with a two-component developer.

Figure 1:
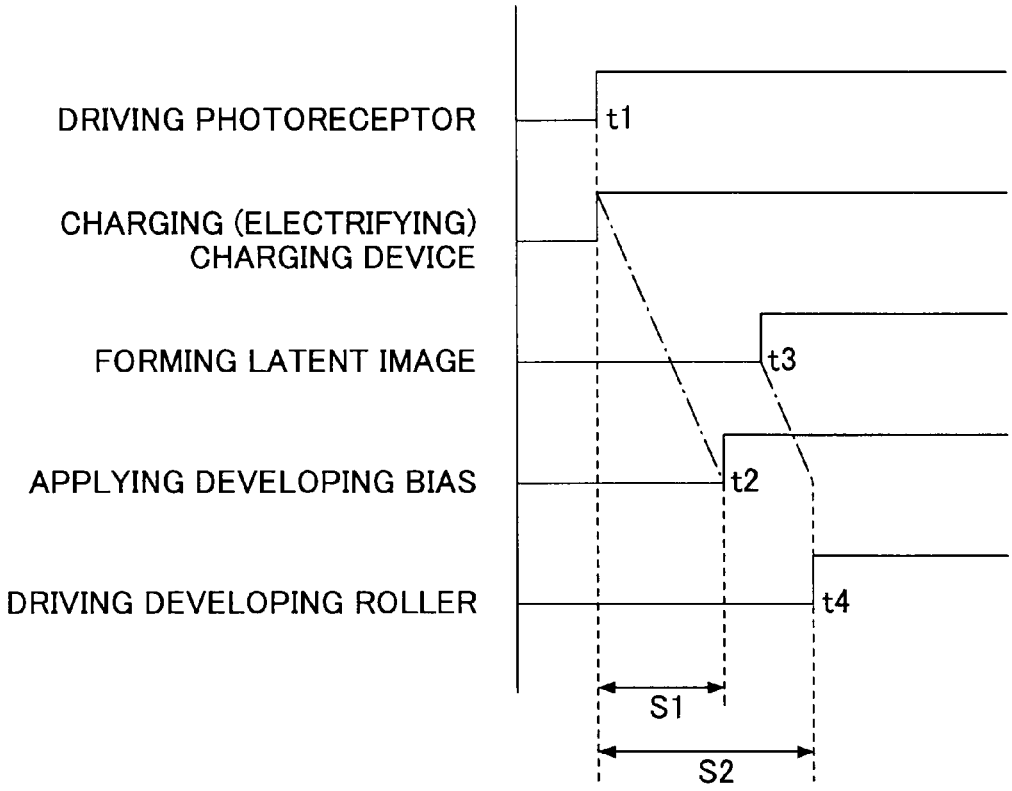
FIG.1 RELATED ART
FIG. 1 illustrates an ordinary method of setting an action of the image forming apparatus according to the related art.
Figure 2:
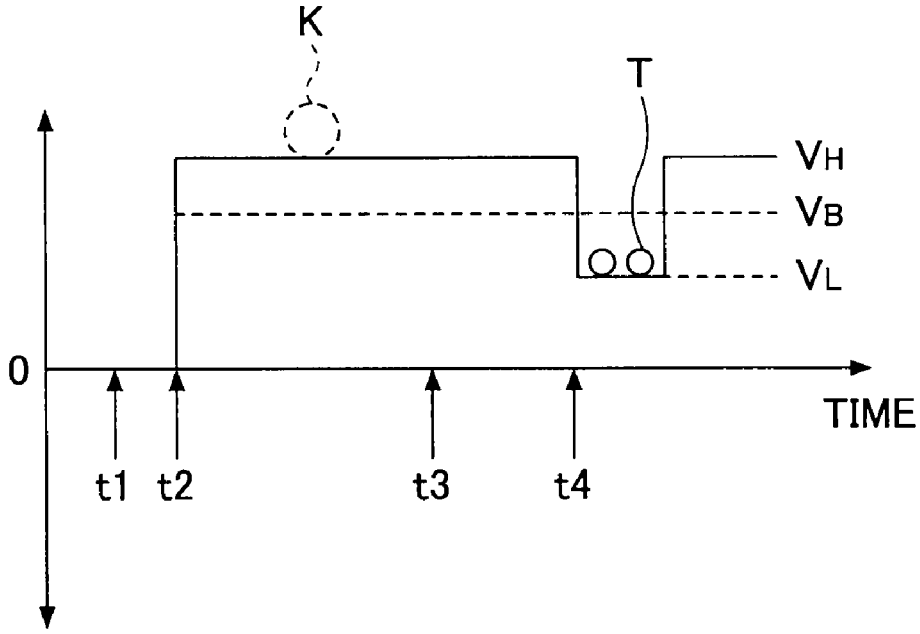
FIG.2 RELATED ART
FIG. 2 schematically illustrates electric potential of the surface of a photoreceptor when the rotating photoreceptor passes a position facing a developing roller.
Figure 3A:
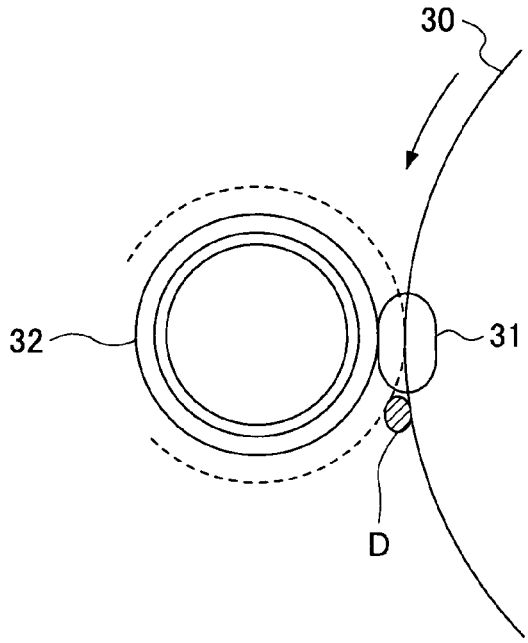
FIG.3A RELATED ART
FIG. 3A illustrates an operation of a photoreceptor in an image forming apparatus of the related art.
Figure 3B:
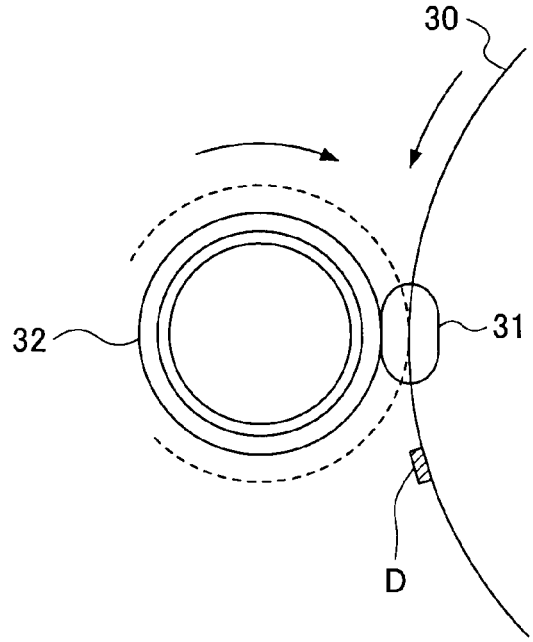
FIG.3B RELATED ART
FIG. 3B illustrates an operation of the photoreceptor in the image forming apparatus of the related art.
Figure 4:
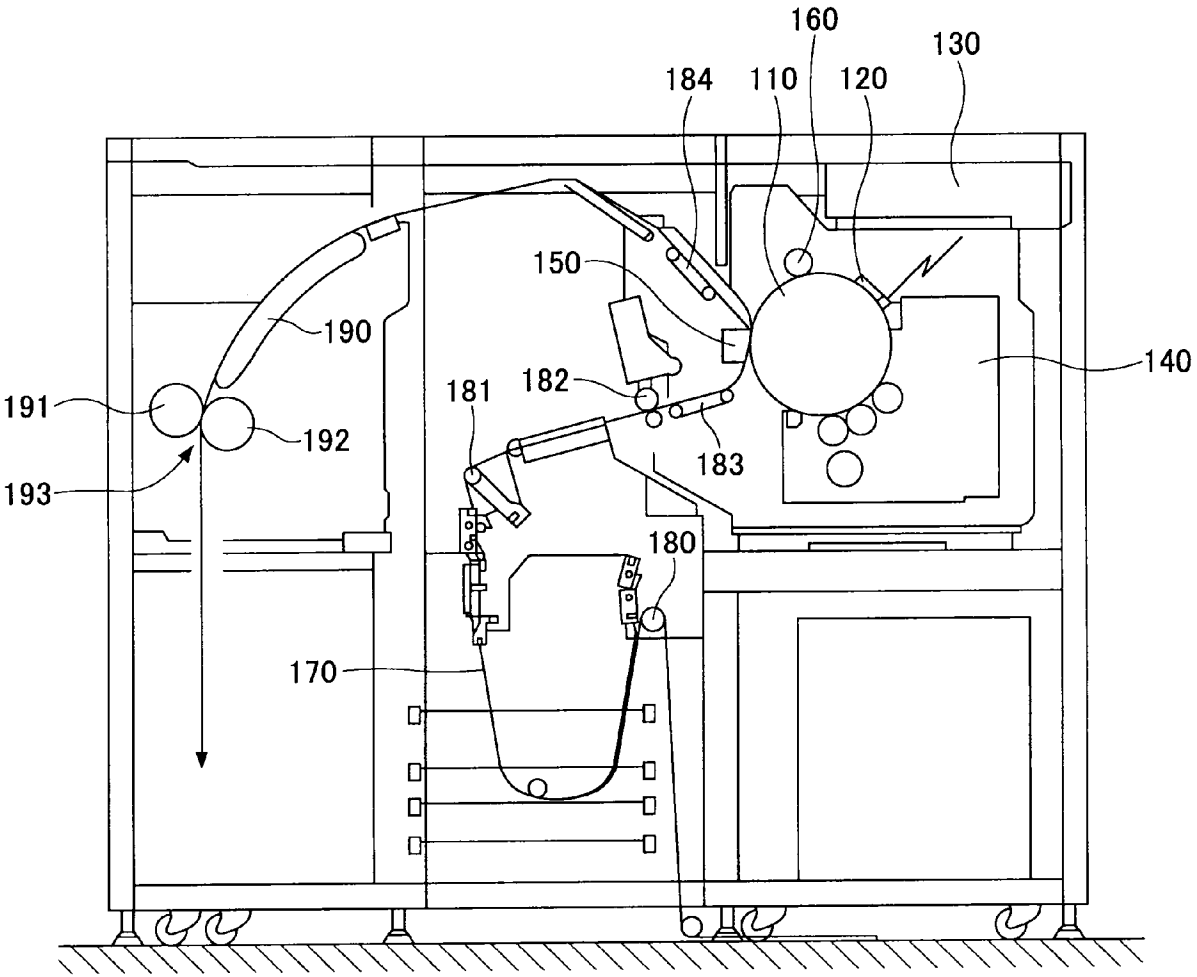
FIG. 4 schematically illustrates an image forming apparatus according to an embodiment of the present invention.

Next, the embodiment of the present invention is described in reference of figures. FIG. 4 schematically illustrates an image forming apparatus according to the present invention.

The image forming apparatus 100 of the embodiment includes a photoreceptor 110 as an image holding body, a charging device 120, an exposure device 130, a developing device 140, a transferring device 150, and a cleaning brush 160. The charging device 120, the exposure device 130, the developing device 140, the transferring device 150, the cleaning brush 160 or the like are arranged along a rotational direction of the photoreceptor 110. Further, the image forming apparatus 100 has a main control unit 200 for controlling driving the photoreceptor 110 and a developing roller. The main control unit is described in detail later.

After electric charges are uniformly attached to the surface of the photoreceptor 110 with the charging device 120, the surface of the photoreceptor 110 on the image forming apparatus 100 is irradiated by a laser beam using the exposure device 130.

Thus, an electrostatic latent image is formed on the surface of the photoreceptor 110. Thereafter, the electrostatic latent image is developed by the developing device 140 thereby forming a toner image of the surface of the photoreceptor 110.

In the embodiment, the photoreceptor 110 is a plus-charged photoreceptor such as a selenium photoreceptor, an organic photoreceptor (OPC), and amorphous silicon (a-Si) photoreceptor.

A developing method of the photoreceptor 110 of the embodiment is a reversal development method, and the toner is positively charged.

A continuous form paper 170 is carried to the transferring device 150 by carrier devices 180 thru 184. The toner image is transferred onto the continuous form paper 170 by the transferring device 150.

The toner image formed on the continuous form paper 170 as a recording medium is heated to have a temperature near a transferring temperature of a toner resin when the toner image passes through a pre-heater 190. The toner image is melted and fixed to the continuous form paper 170 by a fixing device 193 made up of a heating roller 191 and a backup roller 192. The continuous form paper 170 with the toner image fixed to it is ejected outward from the image forming device 100. Toner or the like adhered to the surface of the photoreceptor 110 having the toner image transferred to it is removed by a cleaning brush 160. The removed toner or the like is attracted by a blower (not shown), and is sent to a cyclone filter and a waste toner box. Thereafter, charges on the photoreceptor 110 are removed (neutralized) by a neutralization device such as a neutralization lamp. The electric potential of the neutralized surface of the photoreceptor 110 becomes zero volts (0 V).

Figure 5:
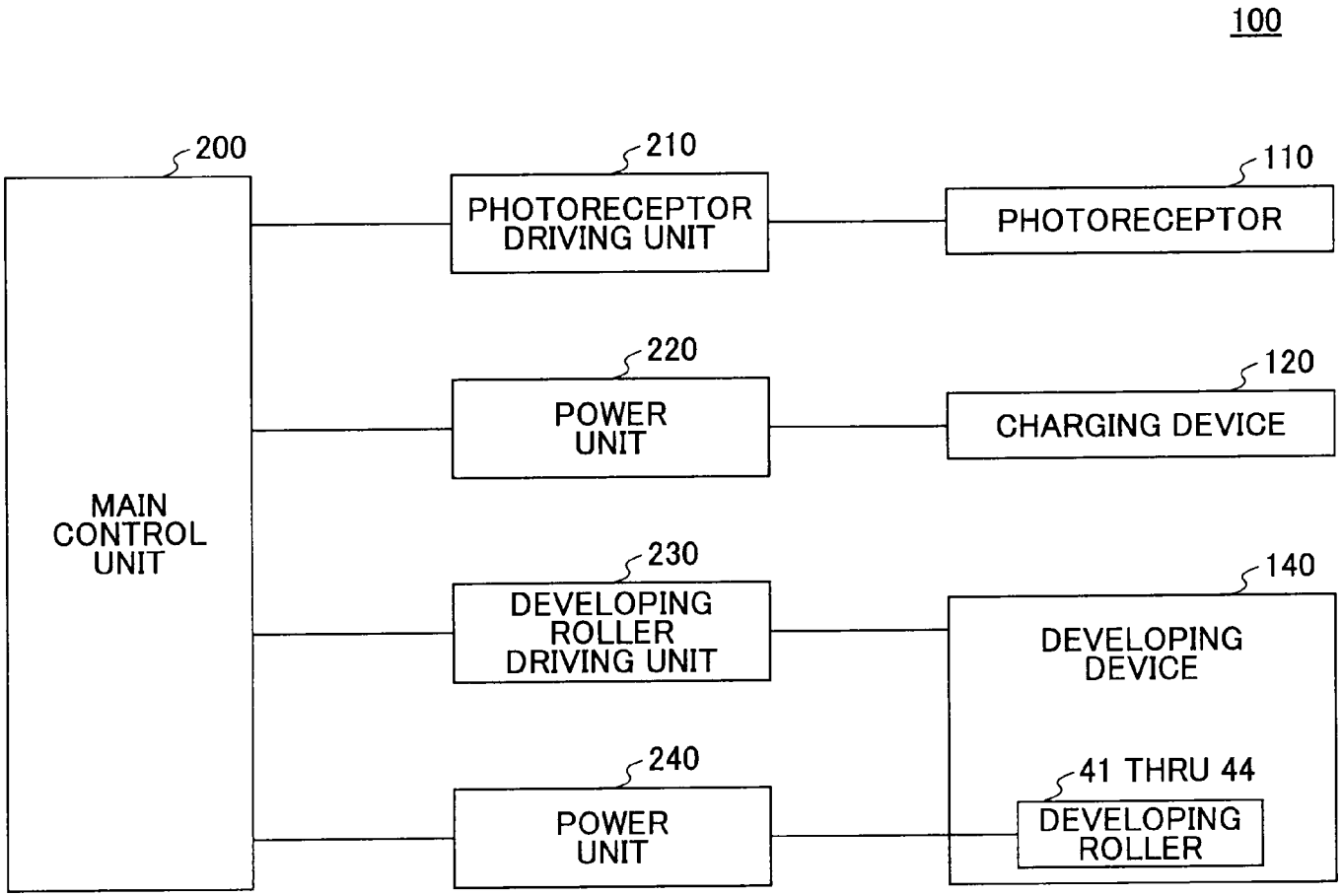
FIG. 5 illustrates a control system of the image forming apparatus.

Next, referring to FIG. 5, control of the image forming apparatus 100 of the embodiment is described. FIG. 5 illustrates the control system of the image forming apparatus.

The image forming apparatus 100 of the embodiment includes a main control unit 200 including a Central Processing Unit (CPU) for controlling the entire image forming apparatus 100. Further, the image forming apparatus 100 includes a photoreceptor driving unit 210, a power unit 220, a developing roller driving unit 230, and a power unit 240, and is controlled by the main control unit 200.

The photoreceptor driving unit 210 controls driving of the photoreceptor 110 upon instruction from the main control unit 200. The power unit 220 applies an electric current to the charging device 120 to charge the photoreceptor 110 upon instruction from the main control unit 200. The developing roller driving unit 230 controls driving of the developing rollers 41 thru 43 described below upon instruction from the main control unit 200. The power unit 240 applies a developing bias voltage to the developing rollers 41 thru 43.

The configured image forming apparatus 100 controls timings of starting to drive the photoreceptor 110, charging of the photoreceptor 110, starting to drive the developing rollers 41 thru 43 of the developing device 140, and application of the developing bias voltage to the developing rollers 41 thru 43.

Next, developer used in the image forming apparatus 100 of the embodiment is described. The image forming apparatus 100 of the embodiment uses two-component developer (hereinafter, simply referred to as developer). The developer of the embodiment includes insulated toner and magnetic carrier. The developing device 140 charges the toner to be positive and the carrier to be negative. Next, the developing device 140 of the embodiment is described in reference to FIG. 6.

Figure 6:
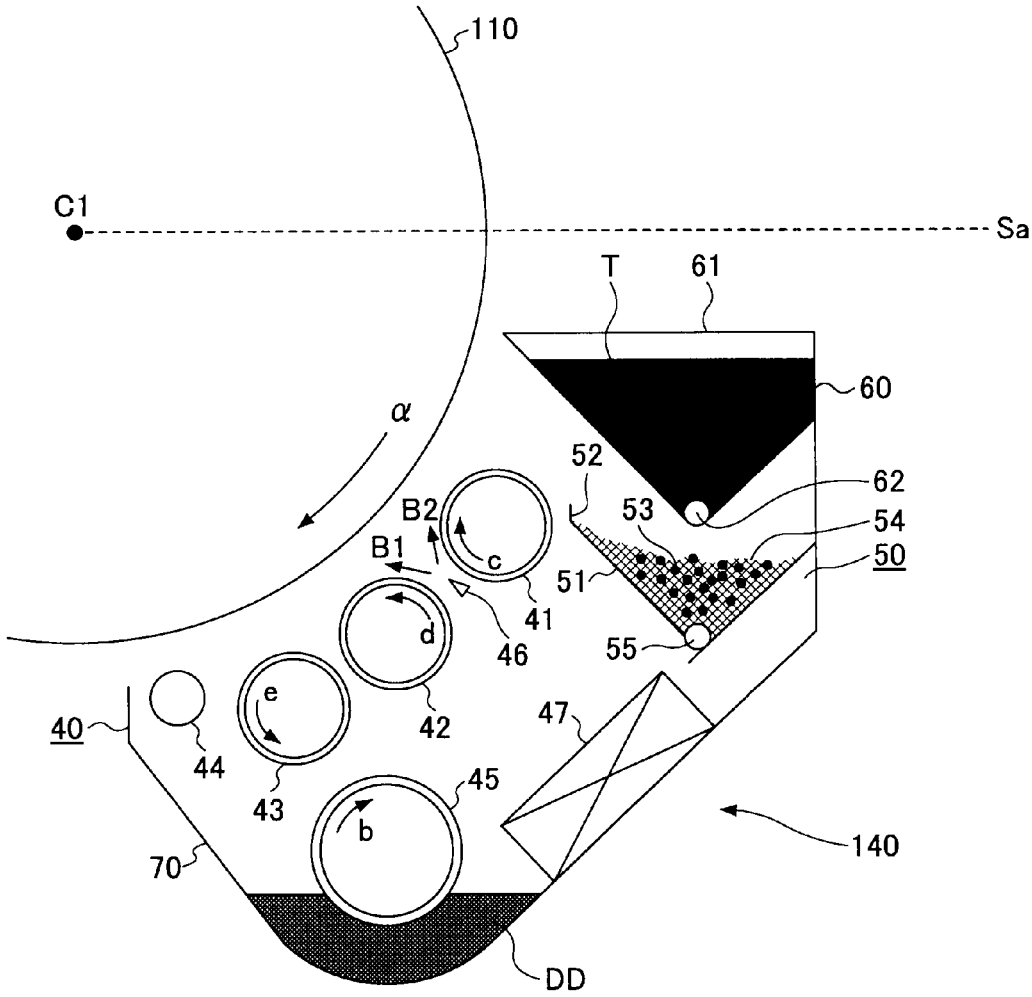
FIG. 6 illustrates a developing device.

FIG. 6 illustrates the developing device. The developing device 140 of the embodiment includes a developing unit 40, an agitating unit 50 and a toner storage unit 60.

The developing unit 40, the agitating unit 50, and the toner storage unit 60 are arranged lower than a line Sa horizontally extending from a center C1 of the photoreceptor 110 in FIG. 6. In the embodiment, airborne toner and carrier are easily recovered inside the developing device 140 because the developing unit 40, the agitating unit 50, and the toner storage unit 60 are arranged to be lower than the photoreceptor 110.

The developing unit 40 includes a developing container 70, the developing rollers 41, 42 and 43, a carrier catch roller 44, a regulation plate 46 ordinarily called a doctor blade, and a mixing agitator 47. The developing container 70 accommodates the developer. The developing rollers 41 thru 43 are developer supplying units which are arranged opposite to the surface of the photoreceptor 110. Although the number the developing rollers is three in the embodiment, the present invention is not limited thereto. The number of the developing rollers may be two, four or more.

The carrier catch roller 44 is set to have a magnetic force greater than that of the developing rollers 41 thru 43. The carrier catch roller 44 removes carrier particles adhered to the surface of the photoreceptor 11 in a developing process.

In the embodiment, it is possible to surely recover the carrier and store it back in the developing unit 40. In the embodiment, by providing the carrier catch roller 44 which is set to have the magnetic force higher than those of the developing rollers 41 thru 43, the carrier airborne inside the developing device 140 is attracted by the carrier catch roller 44 and stored back in the developing container 70. Here, the magnetic force of the carrier catch roller 44 is determined to be 1300 G (Gauss).

The carrying roller 45 brings the developer accommodated in the developing container 70, and supplies it to the developing rollers 41 thru 43.

The developing roller 41 is provided so as to rotate in an arrow direction c (clockwise direction) toward an upstream side of a moving direction of the photoreceptor 110. The developing rollers 42 and 43 are provided so as to rotate in arrow directions d and e (counterclockwise direction). The regulation plate 46 is located between the developing roller 41 and the developing roller 42. The structures of the developing rollers 41 thru 43 and the regulation plate 46 are described later in detail.

In the developing unit 40 of the embodiment, the developer brought and carried by the carrying roller 45 is first sent to a back side of the developing roller 43, namely a side not facing the surface of the photoreceptor 110. Next, the developer carried by the developing roller 43 is sent to a back side of the developing roller 42, which is positioned above the developing roller 43, and further sent to the regulation plate 46.

The developer sent to the regulation plate 46 is then divided into a first developer layer and a second developer layer. The first developer layer is a part of the developer which passes through a gap between the developing roller 42 and the regulation plate 46. The second developer layer is another part of the developer which passes by the back side of the regulation plate 46, passes through a gap between the developing roller 41 and the regulation plate 46, and is carried in a direction of an arrow B2.

The part of the developer of the first layer contacts the surface of the photoreceptor 110 when sent by the developing roller 42 and the developing roller 43 to be used for development of an electrostatic latent image on the photoreceptor 110. The developer having passed through a development area using the developing roller 43 is whittled away or taken out from the surface of the developing roller 43 and returned to a bottom portion of the developing container 70. On the other hand, the other part that is the second developer layer contacts the surface of the photoreceptor 110 when sent by the developing roller 41, to be used for development of an electrostatic latent image on the photoreceptor 110. The developer having passed through the development area using the developing roller 41 is whittled away or taken out from the surface of the developing roller 41 and returned to a bottom portion of the developing container 70 via the mixing agitator 47.

Here, the diameter of the photoreceptor 110 is 262 mm, and the rotational speeds of the photoreceptor 110 are in a range of 571 rpm thru 748 rpm. Further, the diameters of the developing rollers 41 thru 43 is 55 mm, and the rotational speeds of the developing rollers 41 thru 43 are 748 rpm. Furthermore, the diameter of the carrier catch roller 44 is 31.4 mm, and the diameter of the carrying roller 45 is 65 mm.

Next, a structure of the agitating unit 50 of the developing device 140 is described.

The agitating unit 50 of the embodiment is arranged between the developing unit 40 and the toner storage unit 60. The toner and the carrier as the two-component developer are agitated and subjected to frictional charging by the agitating unit 50. The agitating unit 50 includes an agitating chamber 51. Agitating agents 53 and 54 are supported inside the agitating chamber 51 so as to be rotatable to mix the developer sent from the developing roller 41 and the additional toner supplied from the toner storage unit 60, and agitate the mixture. A developer feed roller 55 as a developer supplying unit is supported by the bottom portion of the agitating chamber 51 so that the developer feed roller 55 is rotatable.

Next, a structure of the toner storage unit 60 of the developing device 140 is described.

Only toner T to be mixed with the developer is accommodated in a toner containing unit 61 (hereinafter, referred to as a toner container) forming the toner storage unit 60. A toner feed roller 62 as a toner supplying unit is supported by a bottom portion of the toner container 61 so that the toner feeding roller 62 is rotatable.

The developing device 140 of the embodiment is provided with a toner concentration sensor (not shown). The toner concentration sensor detects a toner concentration of the developer accommodated inside the developing device 140. When the toner concentration deviates from a standard value, the toner T is properly supplied from the toner containing unit 61. The toner concentration of the developer is a ratio between the carrier and the toner.

Described below is an operation of the developing device 140 when an image forming operation is carried out in the image forming apparatus 100 of the embodiment.

Before starting the printing, the two-component powder developer DD is accommodated in the developing unit 40. Further, the developer of a predetermined amount is previously accommodated in the agitating chamber 51. Only the toner T is accommodated in the toner container 61.

When a print start signal is sent, the photoreceptor 110 starts to rotate in a direction of arrow $\alpha$ after the developing rollers 41, 42, and 43, the carrying roller 45, and the carrier catch roller 44 of the developing unit 40 start to rotate. The agitating agents 53, 54 of the agitating unit 50 rotate for a predetermined time period so that the agitating unit 50 frictionally charges the developer inside the agitating chamber 51 to have a predetermined value.

During the printing, the toner in the developing unit 40 is consumed to thereby reduce the toner concentration. When the toner concentration is reduced, the toner concentration sensor provided in the developing unit 40 detects the reduction of the toner concentration.

When the reduction of the toner concentration is detected, the developer feeding roller 55 rotates for a predetermined time, and supplies the developer to the developing unit 40. The developer supplied to the developing unit 40 from the agitating unit 50 is sent to the mixing agitator 47 along with the developer separated from the developing roller 41. The developer is mixed and agitated by the mixing agitator 47 and sent to the bottom portion of the developing container 70.

When the supply of the developer from the developer feeding roller 55 is stopped, the developer separated from the developing roller 41 is carried into the agitating chamber 51 to supplement the developer as much as it has been reduced by supplying it to the developing unit 40. When the amount of the developer in the agitating chamber 51 reaches a predetermined amount, the carrying of the developer into the agitating chamber 51 is stopped.

As described, the developer carried into the agitating chamber 51 is agitated by the agitating agents 53, 54. The toner concentration is detected by a toner concentration sensor (not shown) provided inside the agitating chamber 51. When the toner concentration is lower than a reference concentration, the toner T inside the toner container 61 is supplied via the toner feed roller 62 to the agitating chamber 51.

Figure 7:
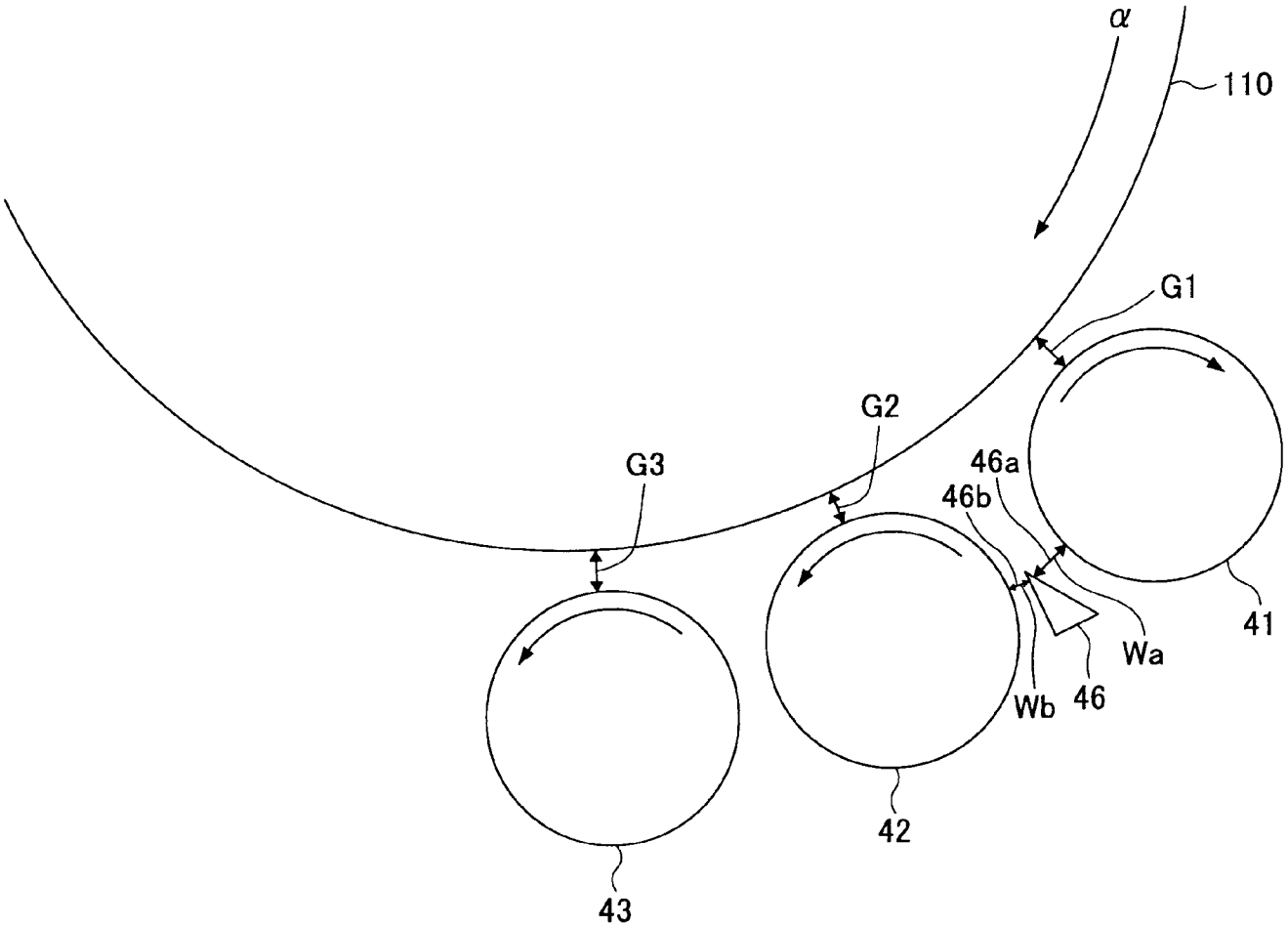
FIG. 7 illustrates a developing roller and a regulation plate in the image forming apparatus.

Next, referring to FIG. 7, the structure of the developing rollers 41 thru 43 and the regulation plate 46 is described. FIG. 7 illustrates the developing rollers 41 thru 43 and the regulation plate 46.

There are a doctor gap 46*a* between the developing roller 41 and the regulation plate 46 and a doctor gap 46*b* between the developing roller 42 and the regulation plate 46 in the developing device 140. Further, the developing device 140 has a development gap G1 between the photoreceptor 110 and the developing roller 41, a development gap G2 between the photoreceptor 110 and the developing roller 42, and a development gap G3 between the photoreceptor 110 and the developing roller 43.

In the embodiment, the developing rollers 42 and 43 are reverse rotation developing rollers which rotate in a direction reverse to the rotational direction of the photoreceptor 110, and the developing roller 41 is a forward rotation developing roller which rotates in the same direction as the rotational direction of the photoreceptor 110. Therefore, the developing roller 41 rotates in the direction reverse to the photoreceptor 110 at a position facing to the photoreceptor 110. In the embodiment, the structure is called "fountain type" in which the developing roller 41 rotating in a direction reverse to the rotational direction of the photoreceptor 110 and the developing roller 42 rotating in a direction the same as the rotational direction of the photoreceptor 110 are included. The development gap G1 is easily clogged in comparison with the development gaps G2 and G3 because the developer is more apt to clog the development gap G1. When the development gap G1 is clogged, the photoreceptor rotation locking easily occurs.

The image forming apparatus 100 of the embodiment prevents the photoreceptor rotation locking from occurring by adjusting a width Wa of the doctor gap 46*a*, a width Wb of the doctor gap 46*b*, magnetic pole angles of the developing rollers 41 thru 43, timings of starting to rotate the developing rollers 41 thru 43, and a timing of starting to rotate the photoreceptor 110.

Figure 8:
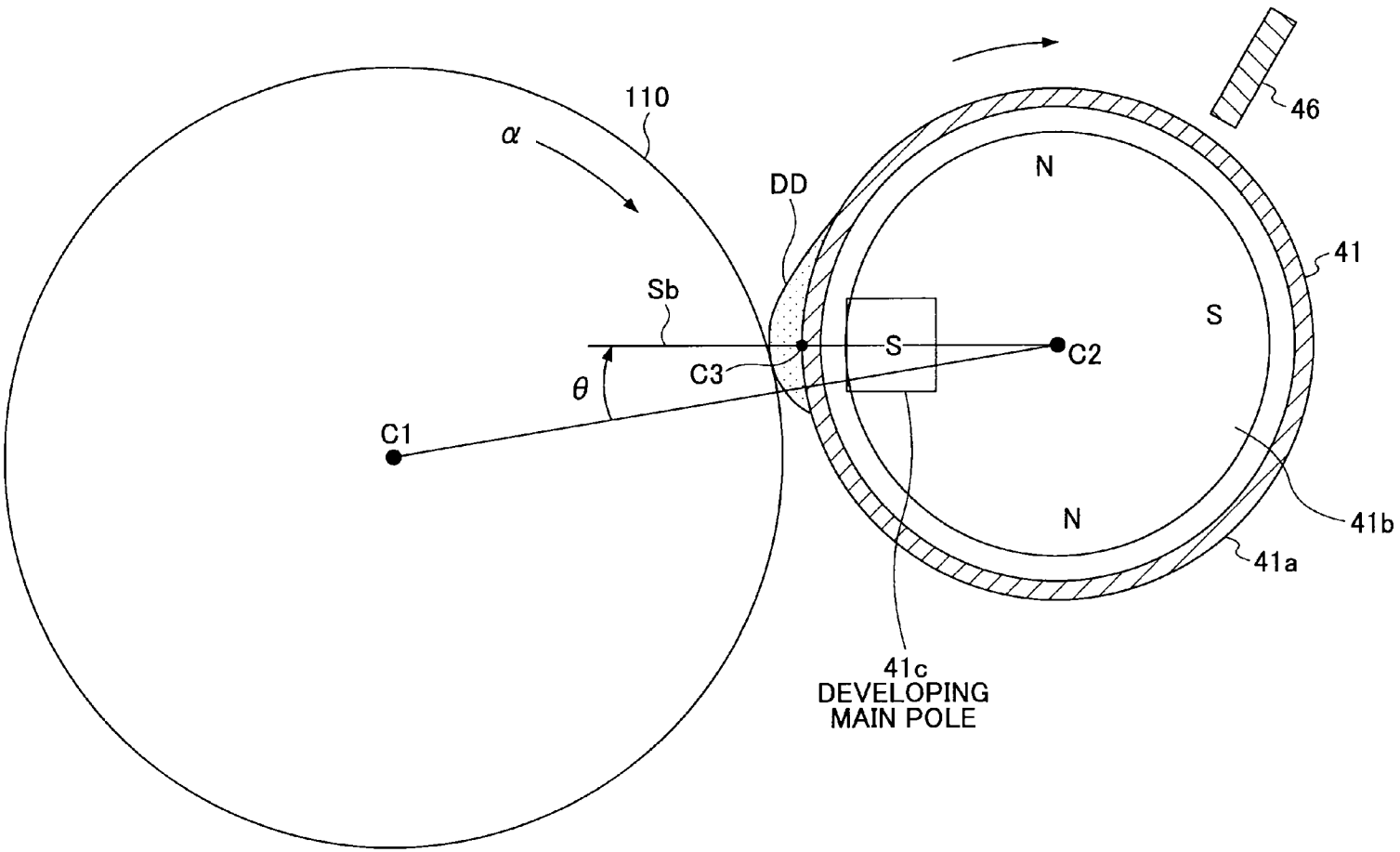
FIG. 8 illustrates a magnetic pole angle of the developing roller.

Next, the magnetic pole angles of the developing rollers 41 thru 43 of the embodiment are described in reference of FIG. 8. FIG. 8 illustrates the magnetic pole angle of the developing roller 41. Referring to FIG. 8, the developing roller 41 is exemplified in explaining the magnetic pole angles of the developing rollers 41 thru 43.

The developing roller 41 includes a sleeve 41*a* having a rotational axis in parallel with that of the photoreceptor 110, and a column-shaped magnet member 41*b* which is fixed to the inside of the sleeve 41*a*. The outer periphery of the magnet member 41*b* is magnetized to have plural magnetic poles S, N, S, and N. A developing magnetic pole unit 41*c* is arranged at a portion opposite to the photoreceptor 110.

The developing roller 41 of the embodiment attracts the developer DD by a magnetic force of the magnet member 41*b* to hold the developer DD on the outer periphery of the sleeve 41*a*. The developer DD is carried by the rotation of the sleeve 41*a* in an arrow direction (clockwise direction) in FIG. 8. The excessive developer DD is whittled away or taken out when the developer DD passes through a gap between the regulation plate 46 and the sleeve 41*a*. Then, the developer is scraped down to uniformly adhere to the outer periphery of the sleeve 41*a*, and thereafter carried to a developing position. In this, the "excessive developer" means developer retained to have a thickness greater than the gap between the sleeve 41*a* and the regulation plate 46 on the outer periphery of the sleeve 41*a*.

The magnetic brush of the developer DD is formed along magnetic field lines around the developing magnetic pole unit 41*c*. The toner image is formed on a surface of the photoreceptor 110 by making the developer DD contact an electrostatic latent image on the photoreceptor 110. In this example, the developing magnetic pole unit 41*c* is a developing main pole.

In the embodiment, provided that the center of the photoreceptor 110 is in C1 and the center of the developing roller 41 is in C2, an angle formed between a line C1-C2 connecting the center C1 and the center C2 and a radial line connecting the center C2 with a position C3 where development is carried out is designated as a magnetic pole angle θ. The position C3 is a position where the magnetic force is largest within an area where the development is carried out. Although the developing roller 41 is exemplified, the definition of the magnetic pole angles is the same for the other developing rollers 42 and 43. However, values of the magnetic pole arrangement and the magnetic force of the developing rollers 41 thru 43 may be different depending on the functions of the developing units. The magnetic force of the developing main poles of the developing rollers 41 and 42 of the embodiment is up to 500 G thru 800 G, and the magnetic force of the developing main pole of the developing roller 43 of the embodiment is up to about 1100 G.

Figure 9:
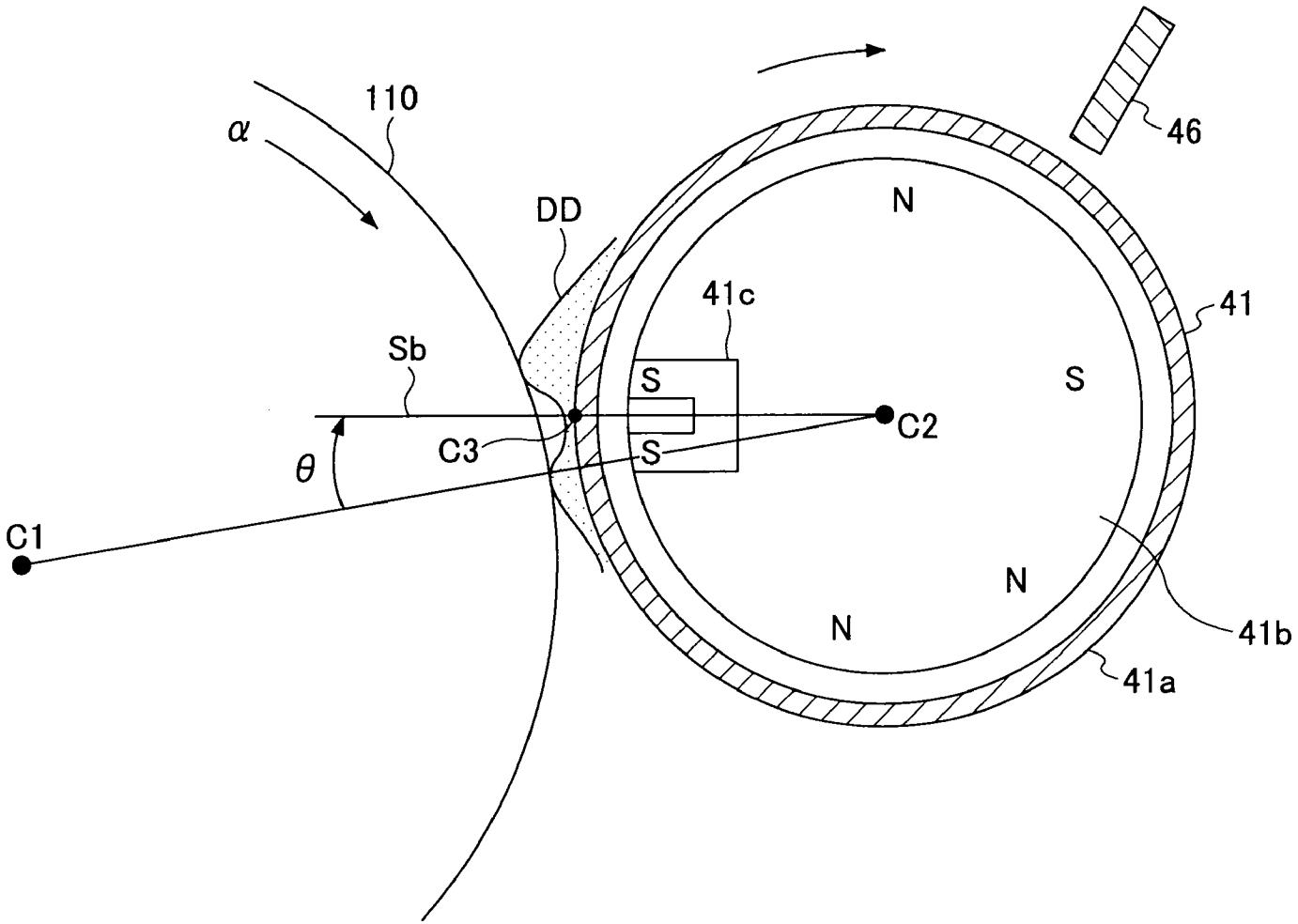
FIG. 9 illustrates an example of a developing magnetic pole unit including two magnetic poles.

Although the developing magnetic pole unit 41*c* has one magnetic pole in FIG. 8, the developing magnetic pole unit 41*c* may be configured to have two magnetic poles (double magnetic poles) as illustrated in FIG. 9. When the developing magnetic pole unit 41*c* is modified to have the two magnetic poles, the magnetic brush may softly contact the photoreceptor 110. Therefore, image defects may be avoidable. FIG. 9 illustrates an example of a developing magnetic pole unit including two magnetic poles, which is partly described in Patent Document 6.

Referring to Table 1, conditions which do not cause the photoreceptor rotation locking to occur are described below. The conditions are about widths of the doctor gaps 46*a* and 46*b*, the magnetic pole angles of the developing rollers 41 thru 43, and timings of starting to rotate the developing rollers 41 thru 43 and the photoreceptor 110.

In the embodiment, jobs of printing twenty sheets of the continuous form paper 170 are carried out as an acceleration test under conditions illustrated in Table 1. The parameters of the acceleration test are a printing darkness density of 1.25 thru 1.30, a printing areal density of 4%, a processing speed of 1650 mm/s (66 inches/s), a surface potential of the photoreceptor 110 of 700 V, and a developing bias voltage of 350 V.

A degraded state of consumable articles may be virtually created by the acceleration test. The greatest load is applied to the developing rollers 41 thru 43 when the developing rollers are started to rotate. Therefore, the acceleration tests are repeated by intermittently driving the developing rollers 41 thru 43. Based on the result of the acceleration test, it is possible to find the conditions causing the clogging of the developer. Here, the printing darkness density is set so as not to cause an image defect to occur.

The image forming apparatus 100 of the embodiment controls the timings of starting to rotate the developing rollers 41 thru 43 and the photoreceptor 110 or the like so that the conditions for avoiding the photoreceptor rotation locking are established.

TABLE 1

| | WIDTH OF DOCTOR GAP | MAGNETIC POLE ANGLE OF DEVELOPING ROLLER | | | TIME PERIOD H BETWEEN STARTING TO ROTATE DEVELOPING ROLLER AND STARTING TO ROTATE PHOTORECEPTOR (msec) | | | | |
|---|---|---|---|---|---|---|---|---|---|
| | Wa/Wb | 41 | 42 | 43 | 2500 | 2000 | 1500 | 1000 | 500 |
| CONDITION 1 | 1.65/0.50 | −5 | −5 | 2.5 | ○ | ○ | ○ | x | x |
| CONDITION 2 | 1.24/0.75 | −5 | −5 | 2.5 | ○ | ○ | ○ | Δ | Δ |
| CONDITION 3 | 1.24/0.75 | −7.5 | −5 | 2.5 | ○ | ○ | ○ | Δ | Δ |
| CONDITION | 1.24/0.75 | −10 | −5 | 2.5 | ○ | ○ | ○ | Δ | Δ |

TABLE 1-continued

| | WIDTH OF DOCTOR GAP | MAGNETIC POLE ANGLE OF DEVELOPING ROLLER | | | TIME PERIOD H BETWEEN STARTING TO ROTATE DEVELOPING ROLLER AND STARTING TO ROTATE PHOTORECEPTOR (msec) | | | | |
|---|---|---|---|---|---|---|---|---|---|
| | Wa/Wb | 41 | 42 | 43 | 2500 | 2000 | 1500 | 1000 | 500 |
| 4 CONDITION 5 | 1.24/0.75 | −15.0 | −5 | 2.5 | ○ | ○ | ○ | Δ | Δ |

When the width Wa of the doctor gap 46*a* is greater than the width Wb of the doctor gap 46*b*, the developer tends to clog in the development gap G1. The reason may be the reverse rotational directions between the photoreceptor 110 and the sleeve 41*a* of the developing roller 41 in the development gap G1, to which the developer is sent by the rotation of the sleeve 41*a* of the developing roller 41. Further, the developer DD is carried against the force of gravity. Therefore, the acceleration tests are carried out sequentially from the condition that the doctor gap 46*a* is wider (the developer DD tends to clog).

In these acceleration tests, time periods H from starting to rotate the developing rollers 41 thru 43 to starting to rotate the photoreceptor 110 are variously changed, and the jobs of printing twenty (20) sheets of the continuous form papers 170 are repeated twenty (20) times respectively for the various time periods H. The time periods H are shifted by 500 ms intervals from 500 ms to 2500 ms. The time period H designates a time from starting the rotation of the developing rollers 41 thru 43 to the starting of the rotation of the photoreceptor 110.

In Table 1, a case where the photoreceptor rotation locking occurs is designated by a mark x; a case where the photoreceptor rotation locking does not occur is designated by a mark ○; and a case where a there is predictor of the photoreceptor rotation locking is designated by a mark Δ.

The predictor of the photoreceptor rotation locking is, for example, a phenomenon in which the developing device 140 is periodically separated from the photoreceptor 110. This phenomenon occurs because the flow rate of the developer passing through the development gap G1 increases due to the great width of the doctor gap 46*a*, and the increased developer may not easily pass through the development gap G1. When the images are continuously formed after the phenomenon occurs, the photoreceptor rotation locking obviously occurs. Therefore, the conditions designated by the mark x may not be adopted. The conditions designated by the mark ○ do not cause the predictor of the photoreceptor rotation locking.

In condition 1 of Table 1, the width Wa of the doctor gap 46*a* is 1.65 mm, and the width Wb of the doctor gap 46*b* is 0.50 mm. In condition 1, the magnetic pole angle of the developing roller 41 is −5°, the magnetic pole angle of the developing roller 42 is −5°, and the magnetic pole angle of the developing roller 43 is 2.5°. The magnetic pole angles are positive when the line Sb illustrated in FIG. 8 is positioned in a clockwise direction relative to the line C1-C2, and the magnetic pole angles are negative when the line Sb illustrated in FIG. 8 is positioned in a counterclockwise direction relative to the line C1-C2.

In condition 1, when the time period H is 500 ms or 1000 ms, the mark is x and the photoreceptor rotation locking occurs. In condition 1, when the time period H is 1500 ms thru 2500 ms, the marks are ○ and the photoreceptor rotation locking does not occur.

In condition 2 of Table 1, the width Wa of the doctor gap 46*a* is 1.24 mm, and the width Wb of the doctor gap 46*b* is 0.75 mm. The magnetic pole angles of the developing rollers 41 thru 43 are the same as those of condition 1.

In condition 2, when the time period H is 500 ms or 1000 ms, the marks are Δ and the predictor of the photoreceptor rotation locking is observed. In condition 2, when the time period H is 1500 ms thru 2500 ms, the marks are ○ and the photoreceptor rotation locking does not occur.

In condition 3, the magnetic pole angle of the developing roller 41 is −7.5°. Other parameters such as the doctor gaps Wa and Wb, and the magnetic pole angles of the developing rollers 42 and 43 are similar to those in condition 2. In condition 3 similar to condition 2, when the time period H is 500 ms or 1000 ms, the marks are Δ, and when the time period H is 1500 ms thru 2500 ms, the marks are ○.

In condition 4, the magnetic pole angle of the developing roller 41 is −10°. Other parameters such as the doctor gaps Wa and Wb, and the magnetic pole angles of the developing rollers 42 and 43 are similar to those in condition 2. In condition 4 similar to condition 2, when the time period H is 500 ms or 1000 ms, the marks are 1, and when the time period H is 1500 ms thru 2500 ms, the marks are ○.

In condition 5, the magnetic pole angle of the developing roller 41 is −15.0°. Other parameters such as the doctor gaps Wa and Wb, and the magnetic pole angles of the developing rollers 42 and 43 are similar to those in condition 2. In condition 5 similar to condition 2, when the time period H is 500 ms or 1000 ms, the marks are 6, and when the time period H is 1500 ms thru 2500 ms, the marks are ○.

As a result of the acceleration test, when the width Wa of the doctor gap 46*a* is 1.65 mm or less, and the developing rollers 41 thru 43 are driven earlier than the timing of starting to drive the photoreceptor 110 by 1500 ms, the photoreceptor rotation locking does not occur. When the width Wa of the doctor gap 46*a* is less than 1.24 mm, the flow rate of the developer in the development gap G1 further decreases. Thus, the photoreceptor rotation locking does not easily occur. Therefore, it is clear that the photoreceptor rotation locking does not occur when the width Wa of the doctor gap 46*a* is less than 1.24 mm, and the time period H is 1500 ms thru 2500 ms.

Further, the image may have a leading end image defect when the doctor gap 46*a* is wider than 1.65 mm. Then, the image forming may not be preferably carried out. The leading end image defect is generated at the leading end of the continuous form paper 170. When the time period H is drastically extended longer than 2500 ms, the photoreceptor 110 may experience filming. Then, the image may not be preferably formed. The filming is a defect that the toner is melted and deposited on the photoreceptor 110 to thereby generate a blank part.

In the embodiment, the magnetic pole angle of the carrying roller 45 is −7.5°, and the widths of the development gaps G1 thru G3 are as shown in Table 2.

TABLE 2

| NAME OF DEVELOPMENT GAP | DEVELOPMENT GAP (mm) FRONT SIDE | BACK SIDE |
|---|---|---|
| G1 | 1.24 | 1.16 |
| G2 | 0.91 | 0.92 |
| G3 | 0.96 | 0.93 |

As illustrated in Table 2, the width of the development gap G1 on a front side is 1.24 mm, and the width of the development gap G1 on a back side of the image forming apparatus 100 is 1.16 mm. Referring to FIG. 4, the "front side" is the left side of the image forming apparatus 100, being a near side of FIG. 4. The "back side" is the left side of the image forming apparatus 100. The widths of the development gaps G2 and G3 on the front and back sides of the image forming apparatus 100 are also shown in Table 2. The processing speed of the image forming apparatus 100 of the embodiment is preferably 1000 mm/s (40 inches/s) or more.

In consideration of the above test results, it is possible to prevent the photoreceptor rotation locking from occurring by controlling the driving of the developing rollers 41 thru 43 and the photoreceptor 110 so that the doctor gap 46*a* is 1.65 mm or less and the time period H is 1500 ms or more. By preventing the photoreceptor rotation locking, a good image without image degradation is obtainable.

Figure 10:
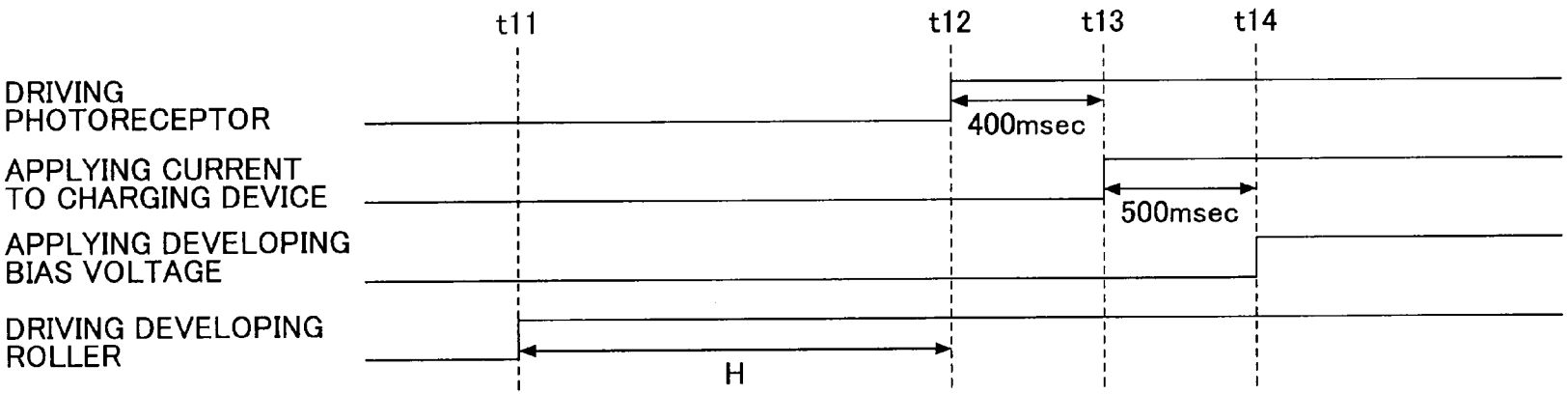
FIG. 10 illustrates a control process carried out by an image forming apparatus as an example.

Next, referring to FIG. 10, a control process carried out by the image forming apparatus 100 of the embodiment is described as an example.

In the image forming apparatus 100, the main control unit 200 controls the photoreceptor driving unit 210, the power unit 220, the developing roller driving unit 230, and the power unit 240. The main control unit 200 controls timings of starting to rotate the developing rollers 41 thru 43 and the photoreceptor 110 so that the time period H is 1500 ms or more.

The main control unit 200 and the developing roller driving unit of the embodiment drive the developing rollers 41 thru 43 at timing t11 to start to rotate the developing rollers 41 thru 43. The photoreceptor 110 is driven by the photoreceptor driving unit 210 to start to rotate the photoreceptor 110 at timing t12 after the timing t11 by the time period H. At this time, the time period H may be 1500 ms or more.

After the photoreceptor driving unit 210 drives the photoreceptor 110, the main control unit 200 applies an electric current to the charging device 120 with the power unit 220 at timing t13 to charging the surface of the photoreceptor 110. The main control unit 200 controls the power unit 220 so that the surface potential of the photoreceptor 110 becomes 700 V. The main control unit 200 controls the photoreceptor driving unit 210 and the power unit 220 to make an interval between timing t12 and timing t13 be 400 ms.

The main control unit 200 applies a developing bias voltage to the developing rollers 41 thru 43 by the power unit 240 at timing t14 after the electric current is applied to the charging device 120. In the embodiment, the main control unit 200 controls the power unit 240 so that the developing bias voltage becomes 350 V. In the embodiment, a time interval between the timing t13 and the timing t14 may be longer than a time until the surface voltage of the photoreceptor 110 becomes a residual potential (voltage of latent image) and shorter than a time necessary for the photoreceptor 110 to rotate by two revolutions.

When the charged region of the photoreceptor 110 comes to a position facing the developing roller when the developing bias potential is not applied (0 V), a difference of the surface potential of the photoreceptor 110 and the developing bias potential applied to the developing rollers 41 thru 43 becomes large. In this case, carrier fly (e.g. beads carry over) tends to occur. Therefore, it is better to shorten the time interval between the timing t13 and the timing t14. For example, the time interval between the timing t13 and the timing t14 is made shorter than a time period between the forming of the charged region on the photoreceptor 110 and the arrival at the position facing the developing rollers. By configuring the image forming apparatus that way, a difference between the developing bias potential applied to the developing rollers 41 thru 43 and the surface potential of the photoreceptor 110 may become small to avoid carrier fly.

In the embodiment, when the process speed is 1650 mm/s (66 inches/s), the time interval between the timing t13 and the timing t14 is 170 ms. When the process speed is 1150 mm/s (46 inches/s), the time interval between the timing t13 and the timing t14 is 500 ms.

As described above, when the above-mentioned controls are carried out by the main control unit 200 under conditions 1 thru 5, it is possible to prevent the occurrence of the photoreceptor rotation locking.

Therefore, when ordinary conditions using ordinary widths Wa and Wb of the doctor gaps (Wa=0.75 mm and Wb=0.75 mm; hereinafter, simply referred to as ordinary condition) are applied to the image forming apparatus 100 of the embodiment, the occurrence of the photoreceptor rotation locking may be prevented.

Next, test results of a case where the ordinary condition is applied to the image forming apparatus 100 of the embodiment are described.

In the image forming apparatus 100 of the embodiment, the widths Wa and Wb of the doctor gaps are set to be the ordinary condition of (Wa, Wb)=(0.75 mm, 0.75 mm), and the magnetic pole angles of the developing rollers 41, 42, and 43 are respectively set at −7.5°, −5°, and 2.5°. Then, a continuous printing test is carried out for 1600 kilo-feet paper with parameters: a printing darkness density of 1.25 thru 1.30, a surface potential of 750 V, a developing bias voltage of 350V, a time period H of 2000 ms, and a printing areal density of 4%. As a result, there occurs no photoreceptor rotation locking. Therefore, it is possible to prevent the photoreceptor rotation locking from occurring by making the time period H be longer than a time necessary for rotating the photoreceptor one revolution, as an example.

Since the image forming apparatus 100 of the embodiment recovers the carrier airborne inside the developing device 140 with the carrier catch roller 44, it is possible to prevent the carrier from adhering to the photoreceptor 110.

In the embodiment, the photoreceptor rotation locking can be prevented from occurring by controlling the timings of starting to rotate the developing rollers 41 thru 43 and the timing of starting to rotate the photoreceptor 110. Further, it is possible to prevent the carrier from adhering to the photoreceptor 110 by recovering the airborne carrier with the carrier catch roller 44 having a magnetic force greater than those of the developing rollers 41 thru 43.

The image forming apparatus of the fountain type configured as described above can prevent the photoreceptor rotation locking from occurring and the carrier from adhering to the photoreceptor 110. Therefore, a preferable image can be formed by the image forming apparatus of the embodiment.

Further, since the image forming apparatus 100 has the developing unit 40, the agitating unit 50 and the toner storage unit 60 arranged downward from the line Sa, it is possible to recover airborne toner and carrier inside the developing device 140.

Although the example of the reversal development which uses the positively charged photoreceptor and the positively charged toner in combination has been described, the same effect as this example is obtainable by a reversal development using a negatively charged photoreceptor and negatively charged toner.

According to the embodiment, it is possible to prevent developer from clogging a gap between developing rollers and a photoreceptor to stop rotation of the photoreceptor when the two-component developer is used, to thereby enable forming preferable images.

All examples and conditional language recited herein are intended for pedagogical purposes to aid the reader in understanding the principles of the invention and the concepts contributed by the inventor to furthering the art, and are to be construed as being without limitation to such specifically recited examples and conditions, nor does the organization of such examples in the specification relate to a showing of the superiority or inferiority of the invention. Although the embodiment of the present invention has been described in detail, it should be understood that various changes, substitutions, and alterations could be made thereto without departing from the spirit and scope of the invention.

This patent application is based on Japanese Priority Patent Application No. 2009-036867 filed on Feb. 19, 2009 and Japanese Priority Patent Application No. 2009-266730 filed on Nov. 24, 2009, the entire contents of which are hereby incorporated herein by reference.

What is claimed is:

1. An image forming apparatus comprising:

a rotatable image holding body configured to hold an electrostatic latent image on a surface of the image holding body;

a developing device including a forward rotation developing roller rotatable in a same rotational direction as that of the rotatable image holding body and a reverse rotation developing roller rotatable in a reverse rotational direction to that of the rotatable image holding body, which supply a two-component developer to the surface of the image holding body to form a toner image corresponding to the electrostatic latent image;

a control unit configured to control rotation of the image holding body, the forward rotation developing roller, and the reverse rotation developing roller to supply the two-component developer; and a regulation plate arranged between the forward rotation developing roller and the reverse rotation developing roller, wherein the control unit controls the rotation of the image holding body to start after a predetermined time period from starting the rotation of the forward rotation developing roller and the reverse rotation developing roller, and wherein a gap between the forward rotation developing roller and the regulation plate is 1.65 mm or less, and a gap between the reverse rotation developing roller and the regulation plate is 0.50 mm or more.

2. The image forming apparatus according to claim 1, further comprising:

a carrier catch roller provided on a downstream side in the rotation direction of the image holding body of the forward rotation developing roller and the reverse rotation developing roller.

3. The image forming apparatus according to claim 2, wherein a magnetic force of the carrier catch roller is greater than magnetic forces of the forward rotation developing roller and the reverse rotation developing roller.

4. The image forming apparatus according to claim 2, wherein the carrier catch roller, the forward rotation developing roller and the reverse rotation developing roller are arranged on a side lower than a horizontal line passing through a rotational center of the image holding body.

5. The image forming apparatus according to claim 1, wherein the predetermined time period is 1500 ms or more.

6. The image forming apparatus according to claim 1, further comprising:

a charging device configured to uniformly charge the image holding body, wherein the control unit controls the charging device to be supplied with an electric current, and the forward rotation developing roller and the reverse rotation developing roller to be supplied with developing bias voltages, in this order, after the forward rotation developing roller and the reverse rotation developing roller are started to rotate and subsequently the image holding body is started to rotate, and a time interval from the application of the electric current to the charging device to the application of the developing bias voltages to the forward rotation developing roller and the reverse rotation developing roller is shorter than a time from forming a charged region on the image holding body by the charging device to arrival of the charged region at a position facing the forward rotation developing roller and the reverse rotation developing roller.

7. The image forming apparatus according to claim 1, wherein a process speed of the image forming apparatus is 1000 mm/s or more.

8. The image forming apparatus according to claim 1, wherein a magnetic pole angle of the forward rotation developing roller is −5° or less, where the magnetic pole angle is an angle of a second line connecting a rotational center of the forward rotation developing roller with a magnetic pole for developing the image at a position facing the image holding body from a first line connecting the rotational center of the image holding body with the rotational center of the forward rotation developing roller, and the magnetic pole angle is positive when the second line rotates beyond the first line in the rotational direction of the forward rotation developing roller and is negative when the second line rotates beyond the first line in the rotational direction of the reverse rotation developing roller.

9. A control method of controlling the image forming apparatus according to claim 1, the control method comprising:

controlling the rotation of the image holding body to start after a predetermined time period from starting the rotation of the forward rotation developing roller and the reverse rotation developing roller, wherein a gap separating the forward rotation developing roller and the image holding body in a development area is greater in width than a gap separating the reverse rotation developing roller and the image holding body in the development area.

* * * * *